US005214229A

United States Patent [19]

Mizuno

[11] Patent Number: 5,214,229

[45] Date of Patent: May 25, 1993

[54] ELECTRONIC MUSICAL INSTRUMENT WITH TONE COLOR SETTING SWITCHES

[75] Inventor: Kotaro Mizuno, Hamamatsu, Japan

[73] Assignee: Yamaha Corporation, Hamamatsu, Japan

[21] Appl. No.: 537,067

[22] Filed: Jun. 12, 1990

[30] Foreign Application Priority Data

Jun. 13, 1989 [JP] Japan ..... 1-148440

[51] Int. Cl.[5] ..... G10H 1/18

[52] U.S. Cl. ..... 84/615; 84/631; 84/617; 84/655; 84/664

[58] Field of Search ..... 84/631, 664, 645, 708, 84/622, 615, 617, 618, 620, 655, 656, 653

[56] References Cited

U.S. PATENT DOCUMENTS 4,450,746 5/1984 Deutsch ..... 84/DIG. 4
4,711,148 12/1987 Takeda et al. ..... 84/453 X
4,773,294 9/1988 Iizuka et al. ..... 84/622
4,862,784 9/1989 Kimpara ..... 84/622
4,867,028 9/1989 Jones ..... 84/735
4,957,552 9/1990 Iwase ..... 84/622
5,044,251 9/1991 Matsuda et al. ..... 84/615
5,074,183 12/1991 Chihana ..... 84/615

FOREIGN PATENT DOCUMENTS 61-18756 5/1986 Japan .
62-52316 11/1987 Japan .

*Primary Examiner*—William M. Shoop, Jr.
*Assistant Examiner*—Brian Sircus
*Attorney, Agent, or Firm*—Spensley Horn Jubas & Lubitz

[57] ABSTRACT

An electronic musical instrument capable of generating musical sounds of a plurality of tone colors simply by designating a plurality of tone colors simultaneously in the tone color switches. The tone color switches may be provided in a front panel adjacent a keyboard.

11 Claims, 9 Drawing Sheets

MAIN ROUTINE

DETECTION AND EXECUTION OF PANEL SWITCH MANIPULATION

KEY ASSIGNER

ELECTRONIC MUSICAL INSTRUMENT WITH TONE COLOR SETTING SWITCHES

BACKGROUND OF THE INVENTION a) Field of the Invention

This invention relates to an electronic musical instrument and more particularly to an electronic musical instrument capable of simultaneously generating musical sounds of a plurality of tone colors in ensemble performance.

In this specification, "ensemble" means performance in more than two kinds of tone colors at the same time.

b) Description of the Related Art

Developments in electronic engineering have made it possible to generate a variety of tone colors in electronic musical instruments. It has become general that a multiplicity of manipulators, called tone color selecting switches or tone color designating switches, for selecting a desired tone color among the multiplicity of tone colors such as piano, flute, violin, synthesizer, etc. are provided on a panel of an electronic musical instrument.

A player of the electronic musical instrument selectively manipulates a tone color selecting switch for selecting a tone color to be generated. In response to the performance in a keyboard, etc., musical sounds of the preselected one tone color are generated.

Japanese Patent Publication No. Sho. 62-52316 proposed the duet or ensemble mode performance where a plurality of tone colors are generated simultaneously in response to a signal performance.

Such an electronic musical instrument is already available which has a duet mode switch and a multiplicity of tone color switches on a panel. When a player selects one tone color and additionally pushes the duet mode switch and another tone color switch, two tone colors are selected to generate musical sounds in two tone colors simultaneously. Thus, the musical sounds can be given depth and variety.

In the prior art as described above, it is necessary, for obtaining a duet or ensemble effect, to push another duet or dual voice switch and then push a tone color switch to be additionally generated. Such two-step (provided that one color has already been selected) action may be cumbersome for the player especially during a performance and may interrupt the performance.

SUMMARY OF THE INVENTION

An object of this invention is to provide an electronic musical instrument which can achieve a duet or ensemble effect through simple actions.

Another object of this invention is to provide an electronic musical instrument which can achieve duet or ensemble performance with a reduced number of switches.

According to an embodiment of this invention, there is provided such an electronic musical instrument in which when a plurality of tone color selecting switches are simultaneously manipulated, a command of ensemble performance is issued, to generate tone signals of the plurality of tone colors corresponding to the manipulated tone color switches.

It is only needed to manipulate desired tone color switches to effect the ensemble performance. Thus, one-step action instead of two-step actions, enables ensemble performance. Also, there is no need to provide for a dual voice switch.

DESCRIPTION OF THE PREFERRED EMBODIMENTS

Figure 1:
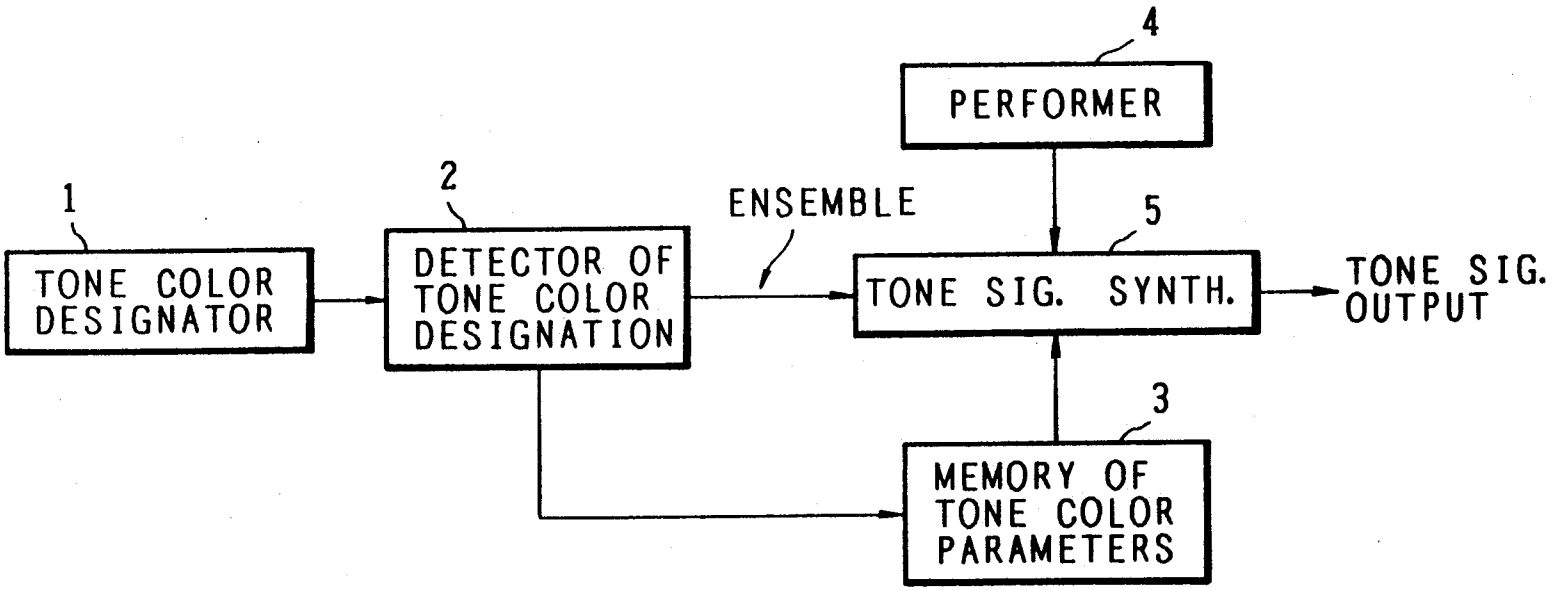
FIG. 1 is a functional block diagram of an electronic musical instrument according to an embodiment of this invention.

FIG. 1 is a functional block diagram of an electronic musical instrument.

A tone color designator 1 includes a plurality of tone color selecting switches, each for designating a tone color, and supplies an output to a detector 2 of tone color designation, capable of detecting simultaneous designation of plural tone colors. The detector 2 supplies a tone color signal representing the designated tone color to a memory 3 storing tone color parameters, which then supplies tone color parameters of the designated tone color to a tone signal synthesizer 5. When a plurality of tone color selecting switches are simultaneously turned on, tone color parameters for the designated plural tone colors are supplied to the synthesizer 5. In such a case, the detector 2 also supplies an ensemble signal representing that an ensemble (or duet or concert or the like) performance is designated, to the tone signal synthesizer 5. When a player achieves performance in a performer 4, such as a keyboard or key switches, tone generation commands including tone pitch signals are supplied from the performance 4 to the tone signal synthesizer 5. The synthesizer 5 generates tone signal waveforms in the designated plural tone colors at each tone generation command, based on the tone pitch signal from the performer 4, the ensemble signal from the detector 2, the tone color parameters from the memory 3, etc..

In the electronic musical instrument described above, designation of ensemble performance in a plurality of tone colors can be done by simultaneously manipulating a plurality of tone color designating switches in the tone color designator 1. When a plurality of switches are operated simultaneously, the detector 2 detects the designation of plural tone colors, and issues a command of ensemble performance. The tone signal synthesizer 5 responds to the command of ensemble performance and generates tone waveforms in ensemble performance according to the tone color parameters of the plural tone colors corresponding to the simultaneously operated switches and supplied from the tone color parameter memory 3.

The electronic musical instrument having such functions as shown in FIG. 1 can be realized in various configurations.

Figure 2:
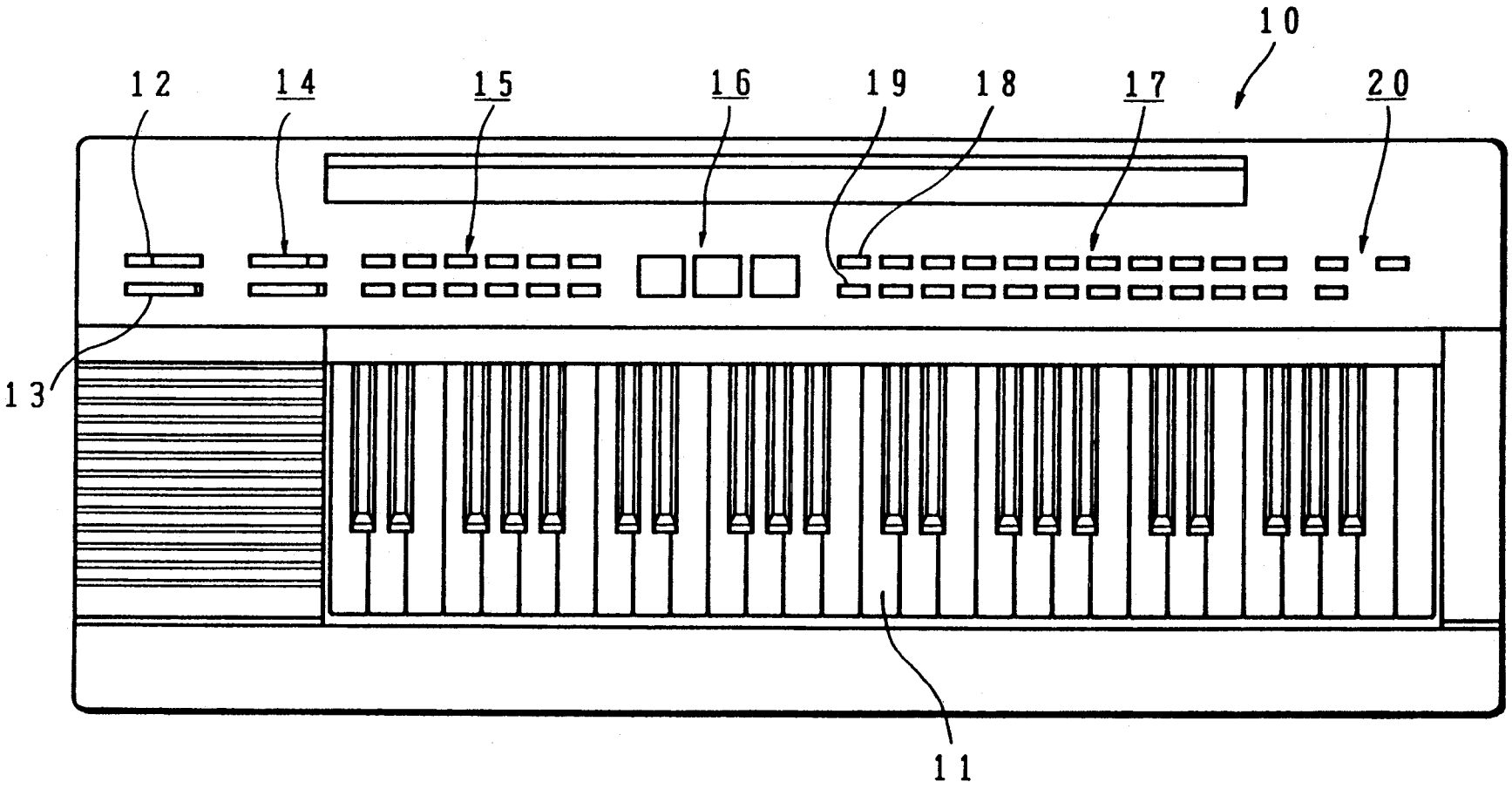
FIG. 2 is a top view of a keyboard type electronic musical instrument incorporating the functional part of FIG. 1.

FIG. 2 is a top view of a keyboard type electronic musical instrument. On the upper face of the instrument 10, there is disposed a keyboard 11 including a multiplicity of keys in the foreground, and in the background a power switch 12, a total volume 13 for controlling the sound volume, switches 14 for selecting a mode of auto bass chord, etc., switches 15 for selecting accompaniment, and pad switches 16 for start/stop control of the automatic accompaniment.

When a player selects an accompaniment pattern by a selection switch 15 and pushes the pad switch 16, automatic accompaniment begins.

In the background of the panel, there are also disposed twenty tone color switches (buttons) 17, a bank change-over switch 18 for selecting bank A side or bank B side for the selection of tone colors, and a sustain switch 19 for effecting sustain to the generated tone. By changing over the bank side by the change-over switch 18, one tone color switch 17 can designate a plurality of tone colors. In this embodiment, two bank sides are provided for. On each depression of the change-over switch 18, side A and side B are changed over. Twenty kinds of tone colors can be selected in the bank A side through twenty tone color switches 17 and another set of twenty tone colors can be selected in bank B side by the twenty tone color switches 17. When bank A side is selected, the following twenty kinds of tone colors can be selected: piano, electric piano 1, harpsichord, marimba, strings, flute, clarinet, saxophone, trumpet, tuba, pipe organ, classic guitar, jazz guitar, banjo, electric bass, synthesizer bass, synthesizer brass, crystal, African percussion, and synthesizer. When bank B side is selected, the switches 17 then represents the following twenty tone colors: honkytonk piano, electric piano 2, vibes (vibraphone), music box, violin, harp, oboe, accordion, trombone, tuba, jazz organ, folk guitar, distortion guitar, acoustic bass, slap bass, landscape, fuzz brass, ice box, birds, and vox.

Namely, twenty tone color switches 17 and a change-over switch 18 enables selection of 40 kinds of tone colors.

Here, when two tone color switches are operated simultaneously, the designated two kinds of tone colors denote performance of duet.

Other switches 20 can denote memory of the performance, performance switch for demonstration, etc..

In ordinary performance, bank A or bank B is selected through the bank selection switch 18 and one tone color switch 17 is pushed to select a desired tone color. Then, sound generation will be effected in the selected one tone color when a player depresses the keyboard 11.

When two tone color switches are pushed simultaneously, two tone colors are selected. When a key in the keyboard is depressed thereafter, sound generation is performed in which sound of designated two tone colors are superposed. In this way, a duet effect or ensemble effect wherein two or more kinds of instruments are performed simultaneously is obtained.

When some tone color switch 17 are newly operated, the tone color designations which have been done theretofore are released. Therefore, when duet of a piano and a violin follows duet of piano and a flute, two tone color switches 17 for designating piano and violin should be pushed simultaneously.

Figure 3:
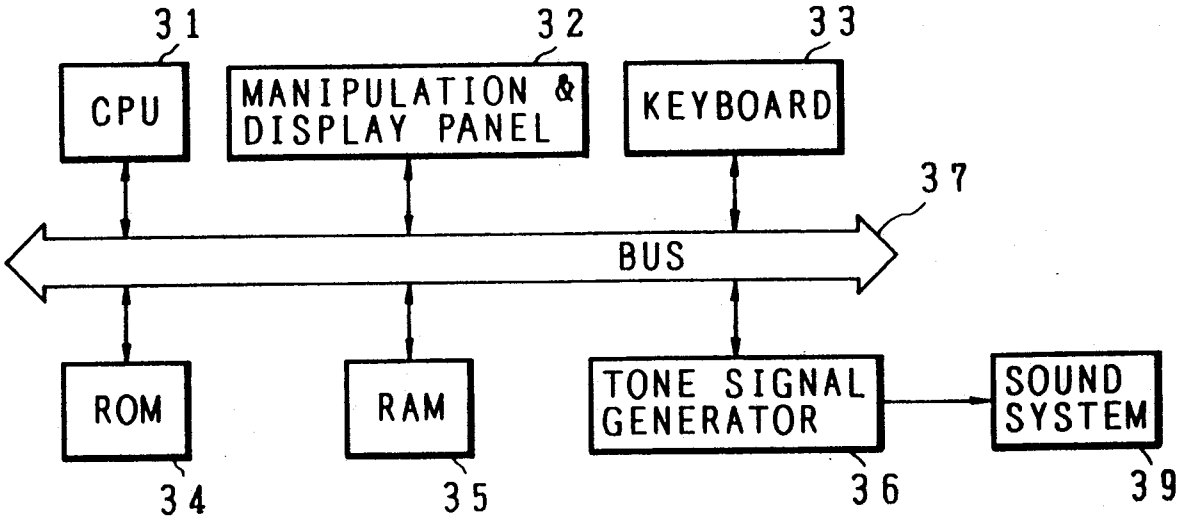
FIG. 3 is a block diagram of an electronic circuit in the electronic musical instrument of FIG. 2.

FIG. 3 shows a hardware structure of the electric circuit of the electronic musical instrument of FIG. 2 embodying the functions of FIG. 1. In the figure, a central processing unit (CPU) 31 for detecting designation of a tone color or a plurality of tone colors, and controlling the operation of the whole electronic musical instrument is connected to a bus line 37. The bus line 37 contains an address bus, data bus and control bus. To the bus line 37, there is also connected manipulation and display panel 32 in which tone color designation is done, a keyboard 33 which supplies key code, key on/-off signal, etc., a read-only-memory (ROM) 34 having a fixed memory, a random access memory (RAM) 35 having a variable memory, and a tone signal generator 36 which can generate tone signals and supplies the output of tone signals to a sound system 39. It is assumed here that there are provided eight tone generating channels in the tone signal generator 36. Among the constituent elements of FIG. 3, the ROM 34, the RAM 35 and the tone signal generator 36 will further be described referring to FIGS. 4 to 6.

Figure 4:
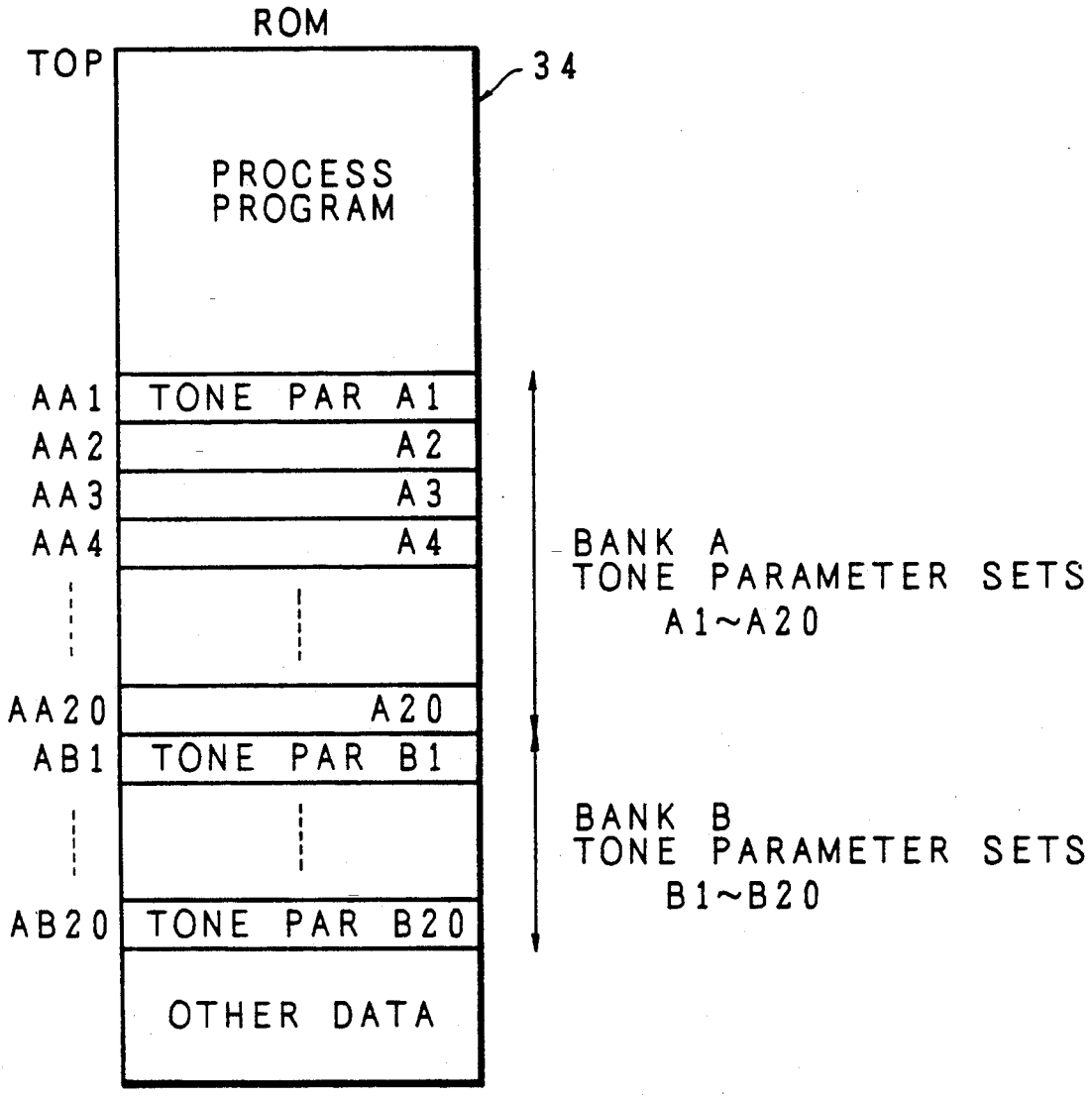
FIG. 4 is a memory map showing the contents of the ROM used in the circuit of FIG. 3.

FIG. 4 shows a memory map for showing the contents of the ROM 34 used in the circuit of FIG. 3. In the ROM 34, first, a processing program for the processing procedure of the CPU 31 is contained, and then tone color parameters TONE PAR A1-TONE PAR A20 for the twenty kinds of tone colors in the bank A and tone color parameters TONE PAR B1-TONE PAR B20 for the twenty kinds of tone colors in the bank B are stored at address AA1 to AA20 and AB1 to AB20. The tone color parameters for bank A correspond to the tone colors which can be selected through twenty tone color switches 17 when bank A side is selected by the bank selection switch 18. Also, the tone color parameters for the bank B correspond to twenty tone colors which can be selected through twenty tone color switches 17 when bank B side is selected by the bank switch 18. There are also stored other data in the ROM 34.

Figure 5:
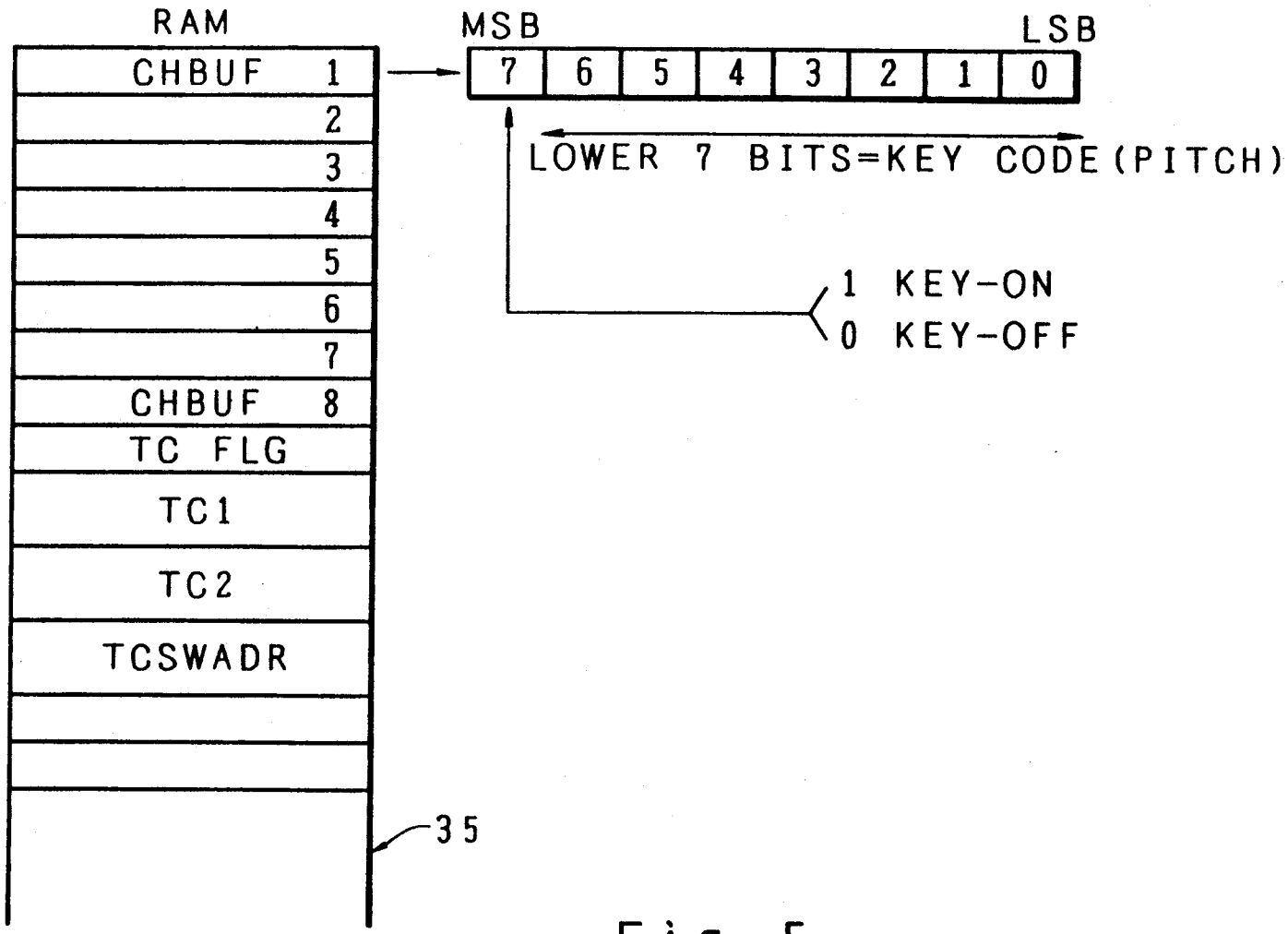
FIG. 5 is a memory map showing the contents of the RAM used in the circuit of FIG. 3.

FIG. 5 shows a memory map showing the contents of the RAM 35 used in the circuit of FIG. 3. In the figure, there are provided eight channel buffers CHBUF 1-CHBUF 8 corresponding to eight tone generating channels in the tone signal generator. Each channel buffer stores a key code in the lower 7 bits and 1 bit data representing key on/off in the most significant bit MSB, in response to the key on/off operation in the keyboard. When a key is depressed, a key-on signal and a key code signal are generated. A key assigner materialized by the CPU 31 and the program stored in the ROM 34 assigns a tone generating channel in the tone signal generator 36 and a corresponding channel buffer in the RAM 35. In the channel buffer, the MSB is set to 1. When the key is released, the MSB is set to 0. The tone color flag TCFLG has the most significant bit MSB representing the ensemble mode which is "1" in the ensemble mode and "0" in the ordinary mode, and the least significant bit LSB which is "1" when the number or address of tone color is written in a register TC1 to be described later, and is set to "0" when all the tone color switches are scanned.

The register TC1 stores the number (address) of the tone color parameter data for generating the selected tone color, i.e. an address among AA1-AA20, and AB-1-AB20 in the ROM 34 of FIG. 4. Another register TC2 also stores an address of the tone color parameter data for generating the additionally selected tone color, similar to the register TC1. In this embodiment, two registers TC1 and TC2 are provided for enabling simultaneous designation of up to two kinds of tone colors for achieving duet performance. A tone color switch address TCSWADR stores and designates an I/O port address corresponding to a tone color switch, to be used in the scanning of the tone color switches.

Figure 6:
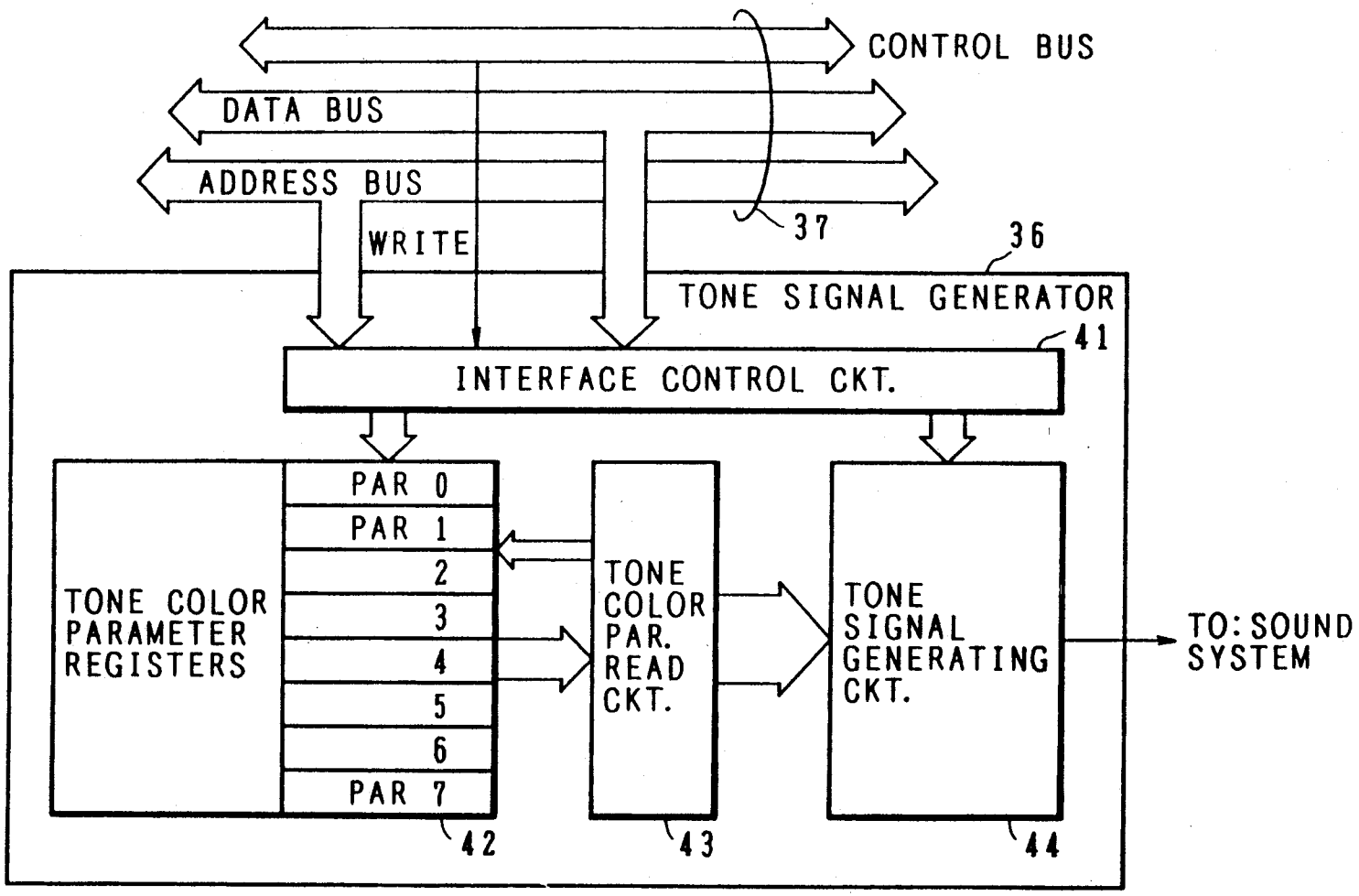
FIG. 6 is a block diagram showing a detailed structure of the tone signal generator used in the circuit of FIG. 3.

FIG. 6 is a detailed block diagram of the tone signal generator 36 in the circuit of FIG. 3. The tone signal generator 36 includes an interface control circuit 41, a tone color parameter register 42, a tone color parameter read circuit 43 and a tone signal generating circuit 44.

The interface control circuit 41 receives the command and data supplied from the CPU 31 to the tone signal generator 36 through the bus line 37, and transmits them to the respective parts.

The tone color parameter registers 42 are registers for temporarily storing the tone color parameter data supplied from the ROM 34. In this embodiment, the tone signal generating circuit is assumed to have eight channels. Thus, the tone color parameter registers 42 have a structure capable of storing eight sets of tone color parameter data. The transferred tone color parameter data are written into a tone color parameter register associated with the assigned channel. Other data such as tone pitch, tone volume, key-on and key-off are given to the assigned tone generating channel in the tone signal generating circuit 44.

The tone color parameter read circuit 43 reads the tone color parameter data for each channel from the tone color parameter registers 42 and supplies the data to the tone signal generating circuit 44.

The tone signal generating circuit 44 generates tone signal waveforms of the designated tone color, tone pitch, and tone volume and supplies the waveforms to the sound system. In the duet mode, when a key in the keyboard is depressed, two tone generating channels are assigned in the tone signal generator 44. A set of tone color parameters is written in one associated parameter register and another set of tone color parameters is written in another associated parameter register. Now, the operation of the electronic musical instrument according to this embodiment will be described referring to the flow charts of FIG. 7 to 9.

Figure 7:
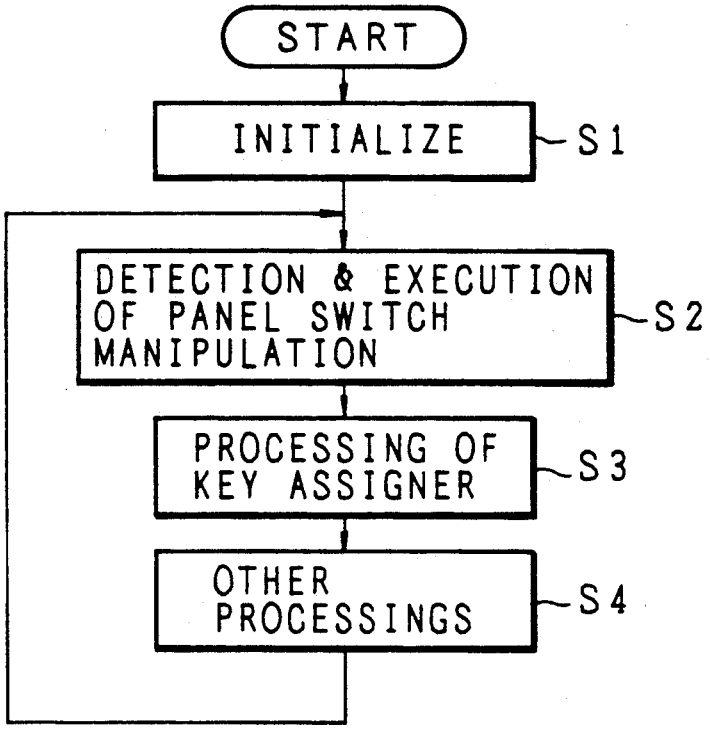
FIG. 7 is a flow chart of the main routine processings of the electronic musical instrument of FIG. 2.

Referring to FIG. 7, when the power for the electronic musical instrument is thrown in, initialization is done in step S1. This is an initializing process of the related parts such as zero clear of various registers in the RAM, etc.. Here, it is assumed that after the power on, tone color of piano is set as a standard tone color. Next, processing for detection and execution of the manipulations of the functional switches on the panel such as tone color switches is done in step S2. Then, key assigner processing is done in step S3. The key assigner processing includes detection of depression and release in the keyboard, designation of a key code (pitch), assignment of a tone generating channel etc.. Step S4 performs other processings. Then, the flow returns to step S2 to repeat steps S2 to S4.

Figure 8:
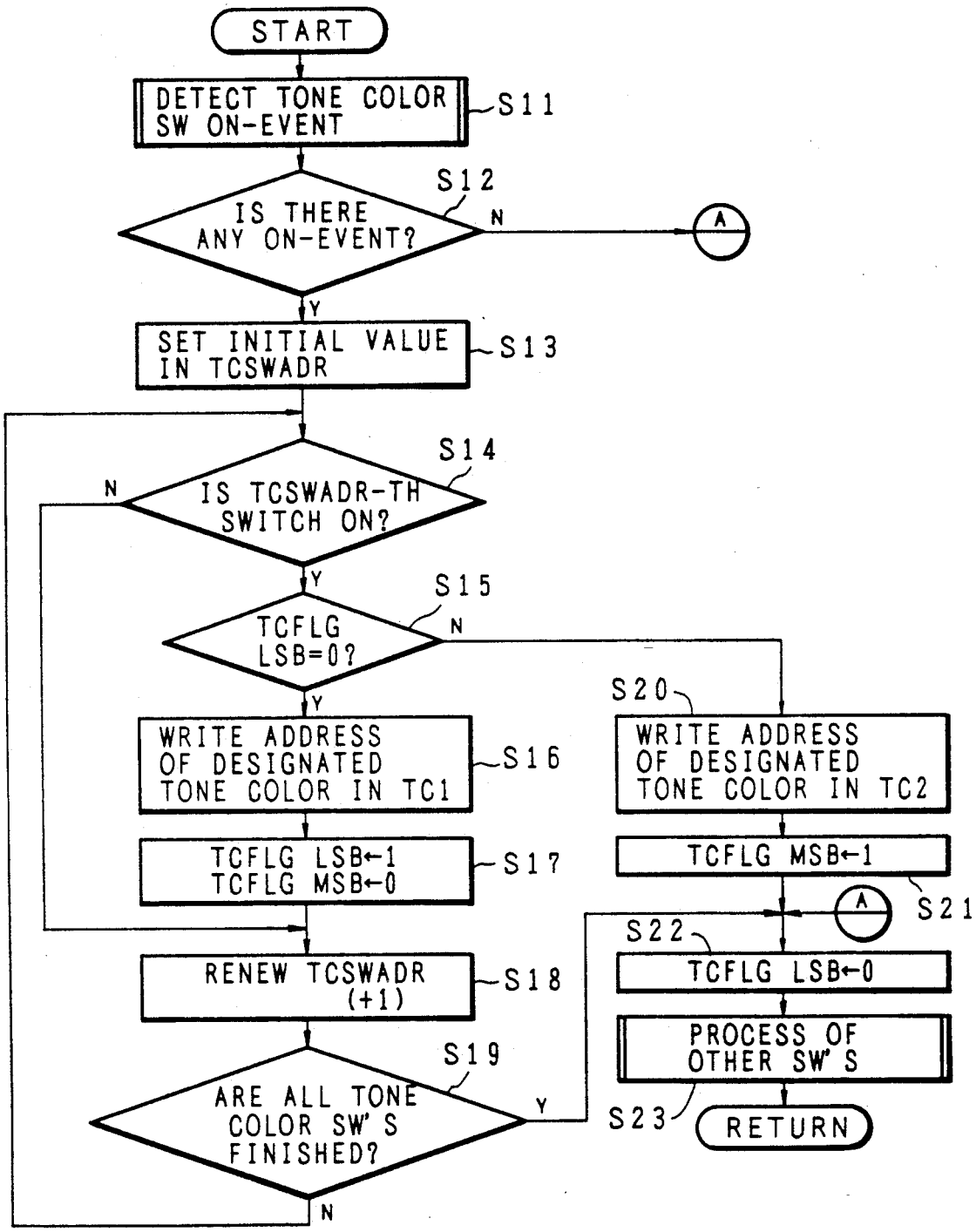
FIG. 8 is a flow chart of the detection and execution routine of panel switch manipulation.

Next processing of detection and execution of panel switch manipulations will be described referring to FIG. 8.

First, when the processing is started, on-events of the tone color switches are detected in step S11. This is a process of detecting depression of the tone color switches by detecting rising of the tone color switch signals from the off state into the on state. Next, discrimination is done whether an on-event has occurred or not in step S12. If there is no on-event, the flow branches to step S22 where "0" is set in the least significant bit of the tone color flag TCFLG. Then processings for other kinds of switches are done in step S23. The flow then returns.

When there is an on-event in step S12, an initial value for the start address of scanning tone color switches is set in the tone color switch address register TCSWADR. Then, in step S14, discrimination is done whether the tone color switch designated by the address register TCSWADR has turned on or not. When the corresponding tone color switch has been turned on, discrimination is done in step S15 whether the least significant bit LSB of the tone color flag TCFLG is "0" or not. If this least significant bit LSB is "0", this detection is the first detection of turn-on of the tone color switch. In step S16, an address data of the tone color parameters in the ROM 34 corresponding to the selected tone color is written in a tone color address register TC1 in RAM 35. Then, in step S17, "1" is set in the least significant bit LSB of the tone color flag TCFLG, and "0" is set in the most significant bit MSB of the tone color flag TCFLG. Then, for searching whether the second tone color switch is manipulated or not, the tone color switch address register TCSWADR is renewed (stepped up) in step S18. Here, if the corresponding tone color switch has not been turned on in step S14, the flow directly branches to step S18.

Then, in step S19, discrimination is done whether the processing has been done for all the tone color switches or not. If the processing for all the tone color switches has not been finished, the flow returns to step S14 to continue processing for the next tone color switch. When it was found that the processing for all the tone color switches has been finished in step S19, the flow branches to step S22 to set "0" in the least significant bit LSB of the tone color flag TCFLG, to perform processing for other kinds of switches in step S23, and then let the flow return.

When the least significant bit LSB of the tone color flag TCFLG is not "0" in step S15, detection of the on state of the second tone color switch is meant. Then the address data of the corresponding tone color parameters is written in the register TC2 of the RAM 35 in step S20. Then, "1" is set in the most significant bit MSB of the tone color flag TCFLG in step S21, to register that the instrument is in the duet mode. Then the flow branches to step S22.

Figure 9:
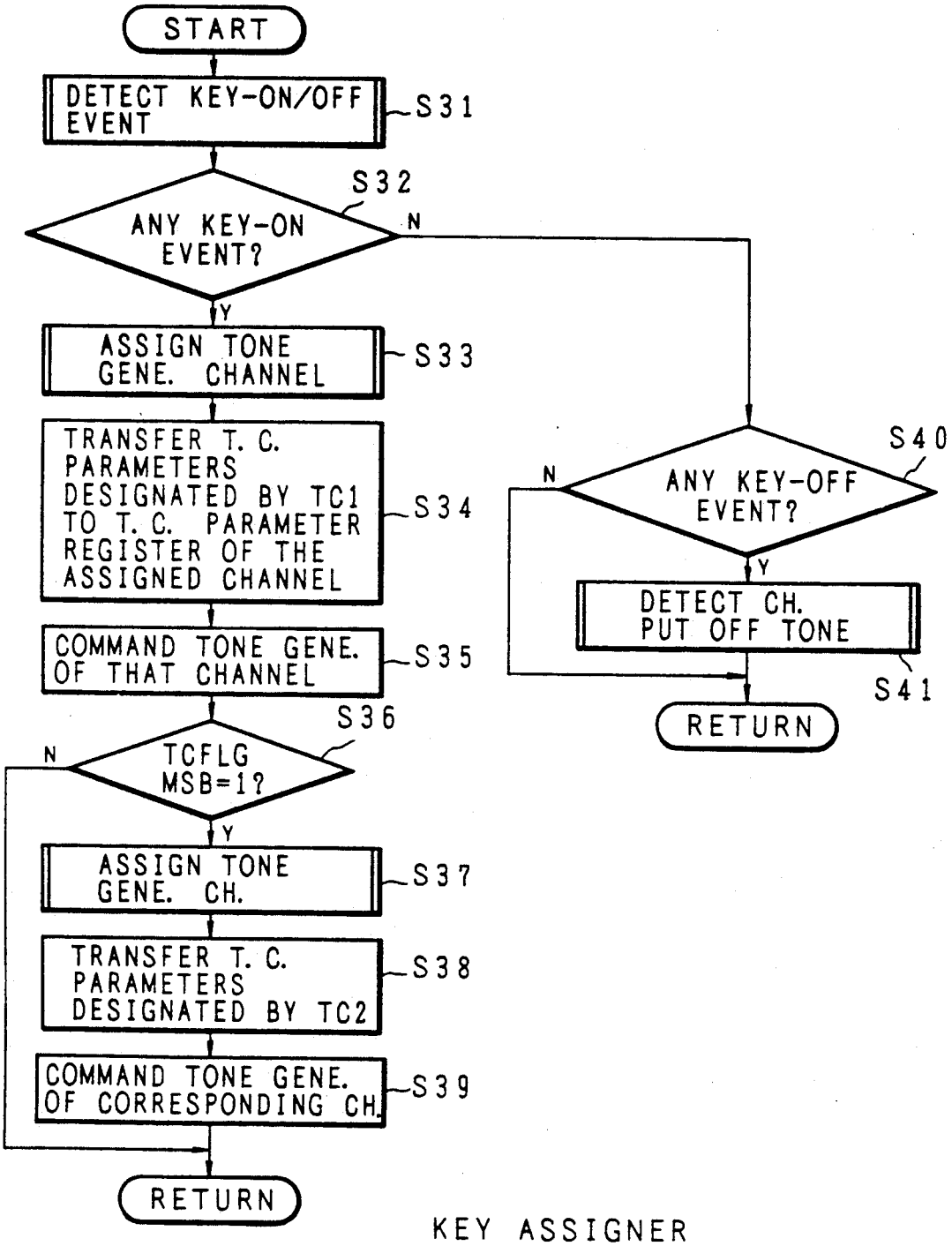
FIG. 9 is a flow chart of the key assigner processing routine.

Next, key assigner processing will be described referring to FIG. 9.

When the key assigner processing is started, key-on events or key-off events are detected in step S31. This is a process of detecting on/off action in the keyboard. Then, discrimination is done in step S32 whether there is a key-on event or not. When there is a key-on event, a tone generating channel for generating a tone signal is assigned in step S33. This processing represents writing a key code in a channel buffer CHBUF shown in FIG. 5 corresponding to the assigned tone generating channel. When all the tone generating channels have been assigned, conventional expedient can be adopted to assign a new channel, such as giving priority to a newly turned-on key, turning off the most decayed tone, giving priority depending on the tone pitch, etc..

Then, in step S34 the tone color parameters designated by the address in the register TC1 are sent to the tone color parameter register 42 corresponding to the assigned tone generating channel. Then in step S35, a command of tone generation is issued to that tone generating channel. Thus, a musical sound of a selected tone color will be generated.

Then in step S36, discrimination is done whether the most significant bit MSB of the tone color flag TCFLG is "1" or not. When MSB is "1", tone generation processing in the duet mode as represented by the steps S37 on is done. In the tone generation processing of the duet sound, first an availalb tone generating channel is detected and assigned in step S37, tone color parameters denoted by the register TC2 are sent in step S38, and tone generation of additionally selected tone color is commanded in the corresponding channel in step S39. After the tone generation of the second tone color the flow returns.

If the most significant bit MSB of the tone color flag TCFLG is not "1" in step S36, it means that no duet performance is desired. Then, the flow directly returns.

When there is no key-on event in step S32, discrimination is done in step S40 whether there are any key-off events. When there is a key-off event, that channel is detected in step S41, to perform the processing for ceasing the tone generation, and let the flow return. When there is no key-off event, the flow directly returns.

According to the embodiment as described above, when designation of a plurality of tone colors is done, the tone color parameters corresponding to the designated plurality of tone colors are read out, and generation of tone signals is performed in the plurality of tone colors. Duet effect is realized with simple one action, without necessity for the cumbersome two step action.

No switch is needed for designating duet performance. Thus the number of switches can be reduced.

Although duet performance is done with designated two tone colors in this embodiment, ensemble performance is not limited hereto, and ensemble performance with three or more tone colors can be done with similar system. Electronic musical instrument other than the keyboard type can also be adopted to incorporate the ensemble performance as described above. Although above described embodiment employs a system which has a CPU (or a micro computer) and program similar functions can be achieved by sole-use hardware structures.

Also, the detection of on-events or off-events of the switches, etc. can be achieved by the interrupt processings. Further, it is also possible to use another tone color memory such as memory cartridge or memory card for suppling tone color parameters for achieving ensemble performance. It is also possible to differentiate the pitch or the tone generating timing for the tones generated in the ensemble performance.

Although the limited number of embodiments have been described hereinabove, the invention is not limited thereto. It will be apparent for those skilled in the art that various alterations, substitutions, modifications, and improvements are possible within the scope of appended claims.

I claim:

1. An electronic musical instrument comprising:

tone color designating means for designating tone color, including a plurality of switches, each for designating a tone color;

switch detecting means for detecting simultaneous turn-on of plural ones of said switches in said tone color designating means and issuing a command of ensemble performance when detected; and tone signal generating means for generating tone signals in the designated plurality of tone colors when said command of ensemble performance is issued.

2. An electronic musical instrument according to claim 1, further comprising:

tone color parameter storage means for temporarily storing tone color parameters for the designated plurality of tone colors and supplying the tone color parameters to said tone signal generating means; and identification storage means for temporarily storing identification information of the tone colors designated in the tone color designating means.

3. An electronic musical instrument according to claim 2, wherein said tone signal generating means and said tone color parameter storage means have the same number of channels and each tone signal generating channel generates a tone signal of a tone color designated by the associated tone color parameter storage channel.

4. An electronic musical instrument comprising:

a front panel;

a keyboard including a plurality of keys for designating a tone pitch;

a plurality of tone color switches disposed in said front panel, each switch being assigned to designate a tone color;

means for detecting simultaneous turn-on of a plurality of said switches and providing a detection signal when detected; and a tone signal generating circuit for generating, in response to said detection signal, tone signals representing a tone pitch designated by said keyboard, and respective tone colors designated by the simultaneous turn-on of the tone color switches.

5. An electronic musical instrument according to claim 4, further comprising:

a bank switch for denoting a bank of tone colors for said plurality of tone color switches among a predetermined number of banks.

6. An electronic musical instrument comprising:

a plurality of tone color switches for designating a tone color when operated;

instructing means for generating an instruction signal instructing start generation of a musical tone;

a plurality of tone generation channels for generating musical tones;

detecting means for detecting simultaneous turn-on of plural ones of said tone color switches and generating a command of an ensemble performance in response to the detection; and assigning means for assigning plural ones of said channels to one instruction signal generated by said instructing means according to said command;

wherein said musical tones having tone colors corresponding to said tone color switches turned-on simultaneously are respectively assigned to said plurality of said channels assigned to said one instruction signal by said assigning means, whereby said musical tones having the tone colors corresponding to said tone color switches turned-on simultaneously are generated in response to said one instruction signal.

7. An electronic musical instrument according to claim 6 wherein said instructing means comprises the keys of a keyboard, and said instruction signal represents a key-on signal.

8. An electronic musical instrument comprising:

a plurality of performance manipulators for designating a plurality of musical tones;

tone color designating means comprising a plurality of switches for designating tone colors, each switch having an ON and an OFF state;

switch detecting means for detecting simultaneous switching of the plurality of switches to the ON state and for issuing a command for ensemble performance when simultaneous ON states are detected;

a plurality of tone signal generators, each being capable of generating different tone signals based on tone information including tone color, the number of tone signal generators being less than the number of performance manipulators, wherein the generated tone signals correspond to the designated tone colors when said command for ensemble performance is issued; and assigning means for assigning tones designated in the performance manipulators to respective tone signal generators.

9. An electronic musical instrument according to claim 8, further comprising:

tone color parameter storage means for temporarily storing tone color parameters for the designated tone colors and supplying the tone color parameters to said plurality of tone signal generators; and identification storage means for temporarily storing identification information of the designated tone colors.

10. An electronic musical instrument according to claim 9, further comprising tone signal generating channels corresponding to the tone signal generators and tone color parameter storage channels corresponding to the tone color parameter storage means, wherein the tone signal generators and the tone color parameter storage means have the same number of channels, and each tone signal generating channel generates a tone signal of a tone color designated by the associated tone color parameter storage channel.

11. An electronic musical instrument according to claim 8, further comprising a bank switch for denoting a bank of tone colors for the plurality of switches among a predetermined number of banks.

* * * * *